US009429050B2

(12) United States Patent
Bayrakdar

(10) Patent No.: US 9,429,050 B2
(45) Date of Patent: Aug. 30, 2016

(54) CAMSHAFT PHASER

(71) Applicant: Schaeffler Technologies GmbH & Co. KG, Herzogenaurach (DE)

(72) Inventor: Ali Bayrakdar, Roethenbach/Pegnitz (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 14/418,018

(22) PCT Filed: May 6, 2013

(86) PCT No.: PCT/EP2013/059340

§ 371 (c)(1),
(2) Date: Jan. 28, 2015

(87) PCT Pub. No.: WO2014/019724

PCT Pub. Date: Feb. 6, 2014

(65) Prior Publication Data

US 2015/0211391 A1 Jul. 30, 2015

(30) Foreign Application Priority Data

Jul. 31, 2012 (DE) ..... 10 2012 213 401

(51) Int. Cl.
*F01L 1/34* (2006.01)
*F01L 1/344* (2006.01)

(52) U.S. Cl.
CPC ..... *F01L 1/34409* (2013.01); *F01L 1/3442* (2013.01); *F01L 2001/34483* (2013.01)

(58) Field of Classification Search
CPC ..... F01L 1/34409; F01L 1/3442; F01L 2001/34483
USPC ..... 123/90.15, 90.17
See application file for complete search history.

(56) References Cited

U.S. PATENT DOCUMENTS

| | | | | |
|---|---|---|---|---|
| 6,609,486 | B2 * | 8/2003 | Trappe | F01L 1/3442 123/90.15 |
| 6,619,248 | B1 | 9/2003 | Bertelshofer et al. | |
| 8,166,937 | B2 | 5/2012 | Yamaguchi et al. | |
| 8,978,606 | B2 | 3/2015 | Arnold | |
| 2003/0051686 | A1 | 3/2003 | Trappe et al. | |
| 2009/0188456 | A1 | 7/2009 | Dupuis et al. | |
| 2010/0116233 | A1 | 5/2010 | Arnold et al. | |
| 2010/0154732 | A1 | 6/2010 | Bayrakdar | |

FOREIGN PATENT DOCUMENTS

| | | |
|---|---|---|
| DE | 10 2008 0010 | 10/2009 |
| DE | 102008056796 A1 | 5/2010 |
| DE | 102010023193 A1 | 12/2010 |

(Continued)

*Primary Examiner* — Zelalem Eshete
(74) *Attorney, Agent, or Firm* — Davidson, Davidson & Kappel, LLC

(57) ABSTRACT

A camshaft phaser, including a stator (1) that can be driven via a crankshaft of an internal combustion engine, and a rotor (2) that can be non-rotatably joined to a camshaft of the internal combustion engine, and a torsion spring (5) that has helical windings and that acts between the rotor (2) and the stator (1) and whose first radially inner end (7) is directly or indirectly joined to the rotor (2), and whose second radially outer end (8) is directly or indirectly joined to the stator (1), whereby a central, axially protruding pipe section (19) associated with the rotor (2) is provided, and the first end (7) of the torsion spring (5) is non-rotatably affixed with a positive fit to the pipe section (19).

10 Claims, 3 Drawing Sheets

(56) References Cited

FOREIGN PATENT DOCUMENTS

| | | |
|---|---|---|
| DE | 10 2009 035233 | 3/2011 |
| DE | 102009042228 A1 | 3/2011 |
| DE | 10 2010 008401 | 8/2011 |
| EP | 1 979 582 B1 | 10/2008 |
| WO | WO 01/61154 | 8/2001 |
| WO | WO 03/085238 | 10/2003 |

* cited by examiner

CAMSHAFT PHASER

The invention relates to a camshaft phaser.

BACKGROUND

A camshaft phaser of the generic type is disclosed, for example, in European patent specification EP 1 979 582 B1. In its basic structure, the camshaft phaser has a stator that can be driven by a crankshaft and a rotor that is non-rotatably joined to the camshaft. Between the stator and the rotor, there is an annular space that is divided into several working chambers by means of projections which protrude radially inwards and which are non-rotatably joined to the stator, each of said chambers being divided into two pressure spaces by means of a vane that protrudes radially outwards from the rotor. Depending on the charging of the pressure chambers with a pressure medium, the rotor is phased either in the "early" or "late" direction with respect to the stator, and thus also the camshaft with respect to the crankshaft. The pressure build-up of the pressure medium likewise takes place via the crankshaft, as a result of which only a slight flow of pressure medium is provided at low rotational speeds. This slight stream of pressure medium has the disadvantage that, under unfavorable conditions, an undesired change in the setting of the camshaft phaser can occur which, in turn, can lead to unfavorable operating behavior on the part of the internal combustion engine, especially during the cold-start phase, along with unfavorable consumption values and rough running. For this reason, the camshaft phaser disclosed in European patent specification EP 1 979 582 B1 proposes a helical torsion spring between the rotor and the stator. A radially outer end of the torsion spring is attached to a projection associated with the stator, while a radially inner end of the torsion spring is attached to a pin associated with the rotor. The helical spring is secured towards the outside by means of a cover that is pressed into a ring-cylindrical projection of the stator.

SUMMARY OF THE INVENTION

It is an object of the present invention to provide camshaft phaser having a helical torsion spring that should be inexpensive to produce and easy to install.

The present invention provides a central, axially protruding pipe section associated with the rotor is provided and that the first end of the torsion spring is non-rotatably affixed with a positive fit to the pipe section. The proposal being made to achieve the objective is that the torsion spring is centrally held by its first end on the camshaft phaser. In this manner, the last inner winding of the torsion spring can be shaped in such a way that this winding can, at the same time, be used to affix the torsion spring to this end. Since the rotor has a central hole because of the pressure medium feed, it is particularly advantageous to fasten the first spring end to a pipe section that protrudes axially, in other words, in the plane of the helical torsion spring, so that the torsion spring does not have to be bent out of the plane in order to be fastened. Moreover, there is no need to provide a separate fastening projection or pin, provided that a pipe section of a component is used that is already present to fulfill another function such as, for example, a component of the hydraulic system.

An especially simple way to fasten the first spring end can be achieved in that the pipe section is configured so as to be out-of-round, at least in some sections, and in that the first end of the torsion spring is non-rotatably affixed to the pipe section, thanks to a shaping that is adapted to the out-of-round shape of the pipe section. For purposes of fastening the first end of the torsion spring, it is only slid with this end onto the pipe section and it is subsequently non-rotatably affixed to the pipe section at the same time, thanks to shaping of the pipe section and of the spring end.

In particular, the pipe section can be part of a pipe that extends through a central opening in the rotor and that serves, for instance, to convey the pressure medium.

Moreover, the pipe section can be part of a central screw to join the rotor to the camshaft, which is particularly practical when an out-of-round pipe section is employed, especially one having a flat face, since, in this case, the pipe section can simultaneously be used as a force-attack surface for tightening the central screw.

In this case, it is particularly advantageous if the flat face is in the form of a square and if the spring end is in contact with at least three of the straight side faces of the square, so that the torsion spring is secured to the pipe section in a captive manner, even while the rotor is rotating relative to the stator.

It is also proposed for the torsion spring to be secured by a locking part that laterally covers the windings on the outside, so that the torsion spring does not buckle sideways, even under load.

It is likewise proposed for the locking part to axially secure the first spring end that is non-rotatably affixed to the pipe section.

In a preferred embodiment, the locking part can be formed by a securing assembly consisting of a locking disk and of a locking ring that secures the locking disk to the pipe section so that it cannot move. The locking disk here serves to laterally secure the windings as well as the first spring end, and it is itself affixed to the pipe section by the locking disk, so that it cannot move in the pull-off direction. In this manner, the locking disk can also be configured and shaped in such a way that it extends radially beyond the outer windings of the torsion spring and its radially outer edge is non-rotatably joined to the stator, as a result of which it practically forms a housing for the torsion spring. In this case, the rotor also executes the rotational movement with respect to the locking disk, which is made possible by the proposed approach in that the locking disk is not affixed to the pipe section but is, instead, secured axially by means of the locking ring.

It is likewise proposed for the first spring end to surround the pipe section at an angle of at least 270°, which results in a secure fastening while also translating into a convenient installation. In this context, the first spring end is preferably affixed to the pipe section with less than a complete winding, in other words, less than 360°, so that, for installation purposes, it can be slightly widened and subsequently affixed to the pipe section with a clamping fit.

BRIEF DESCRIPTION OF THE DRAWINGS

The invention will be described in greater detail below on the basis of an embodiment of the invention. The following is shown.

DETAILED DESCRIPTION

Figure 1:
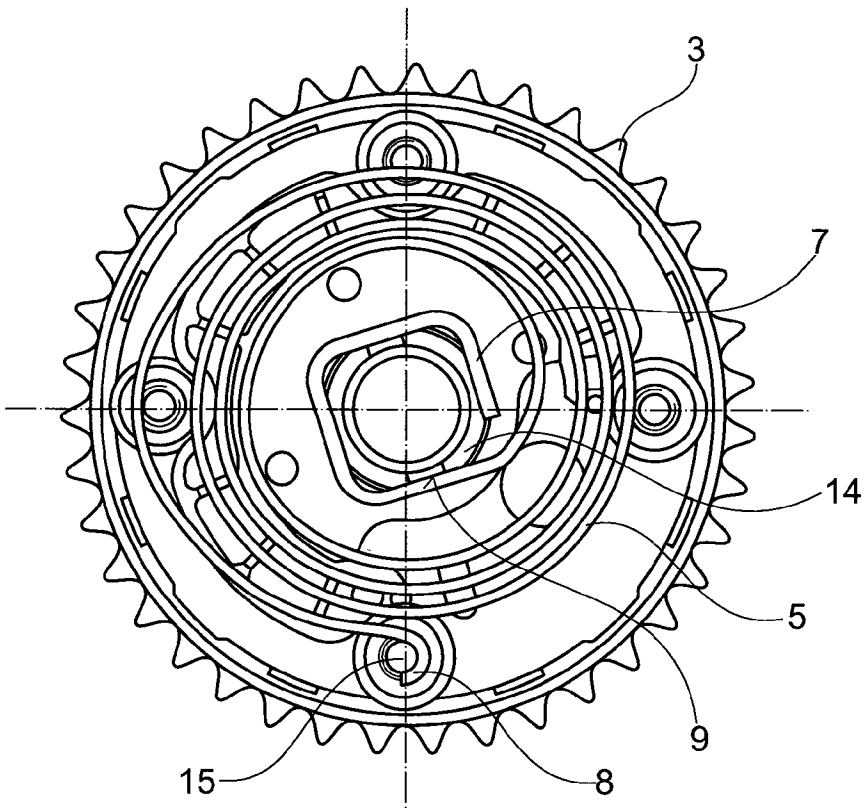
FIG. 1 a camshaft phaser with a torsion spring.
Figure 1:
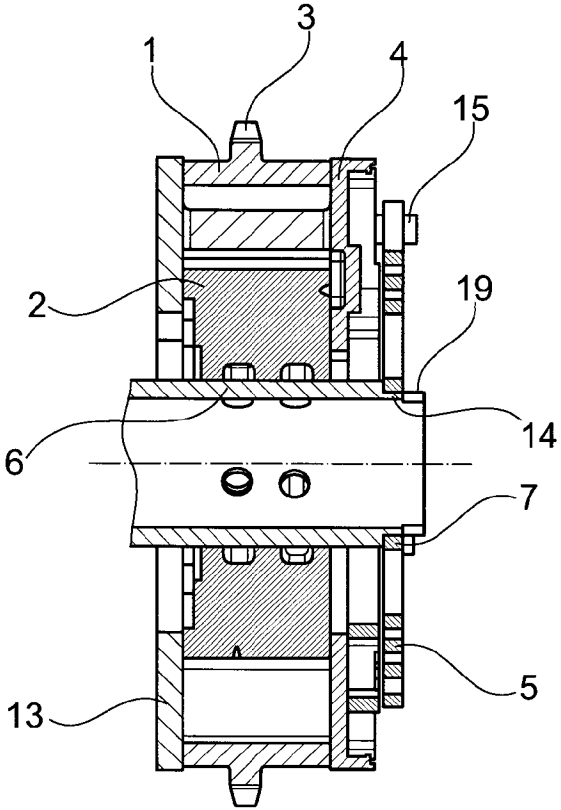

FIG. 1 shows a camshaft phaser in a sectional view as well as in a view towards a torsion spring 5. The basic structure of the camshaft phaser consists of a stator 1 having outer teeth 3 and a rotor 2. The stator 1 can be rotationally driven by means of a crankshaft of an internal combustion engine via a continuous belt and chain drive, whereas the rotor 2 can be non-rotatably joined to a camshaft of the internal combustion engine. Between the stator 1 and the rotor 2, there is an annular space that is divided into working chambers by means of projections that are non-rotatably joined to the stator, said chambers, in turn, being divided into opposing pressure spaces by vanes that are non-rotatably joined to the rotor. These pressure spaces can be connected to a hydraulic system by means of which the pressure spaces can be selectively charged with a pressure medium, either in the "early" or "late" direction with respect to the stator 1 and the crankshaft, in order to adjust the rotor 2 and the camshaft. The pressure spaces are closed at the side by sealing covers 4 and 13. The sealing covers 4 and 13 are joined to the stator 1 or to the projections by pins 15, so that the sealing covers 4 and 13, the stator 1 and the projections can be seen as a non-rotatable unit.

In a central opening of the rotor 2, there is a pipe 6 which has passage openings for the pressure medium and whose pipe section 19 protrudes beyond the end face of the rotor 2. Moreover, a torsion spring 5 is provided that acts between the rotor 2 and the stator 1. The pipe section 19 is configured so as to be out-of-round and it is provided with a flat face 9 to which a first radially inner end of the torsion spring 5 is positively affixed in the circumferential direction. If the pipe 6 is, for example, part of a central screw that serves to join the rotor 2 to the camshaft, the flat face 9 can be simultaneously employed to tighten the central screw. The torsion spring 5 extends in a plane radially outwards from the first end 7 into several helical windings all the way to a second end 8 that is attached to one of the pins 15.

Figure 2:
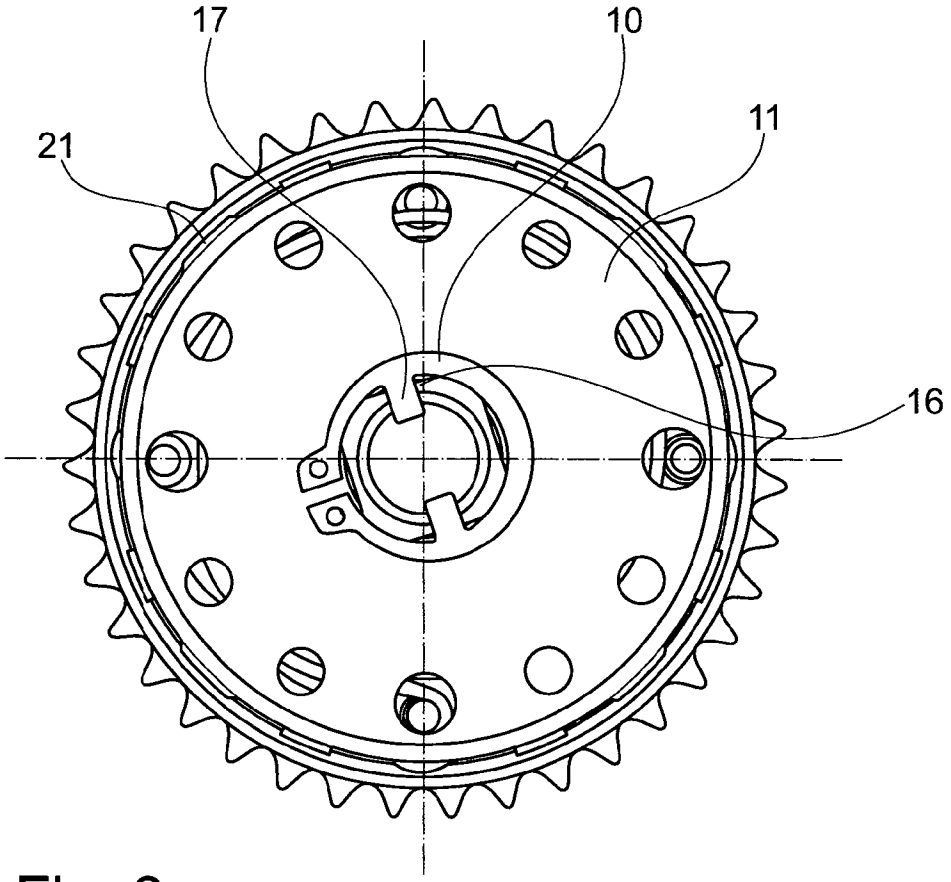
FIG. 2 a camshaft phaser with a torsion spring and a locking part.
Figure 2:
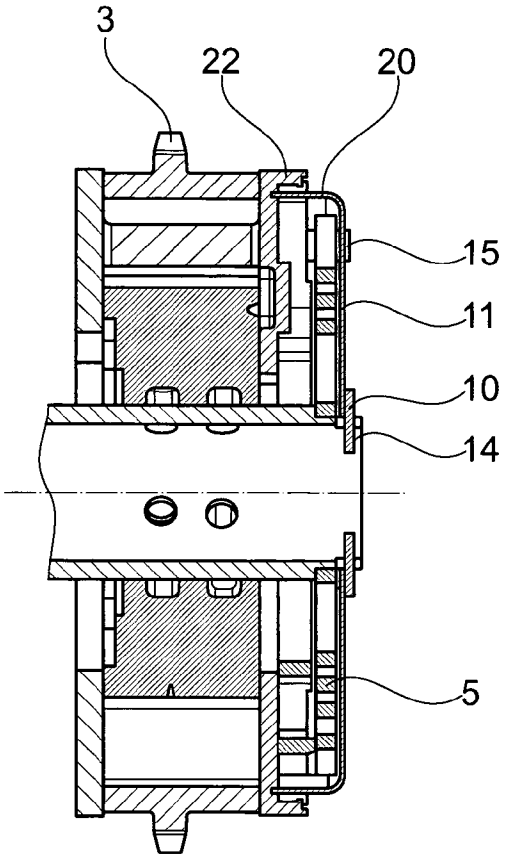

In order to secure the torsion spring 5, as can be seen in FIG. 2, a locking part is provided in the form of a locking assembly consisting of a locking disk 11 and of a locking ring 10 that engages into a groove on the pipe section 19. The radial inside of the locking disk 11 is arranged between the locking ring 10 and the first end 7 of the torsion spring 5 that is affixed to the flat face 9, as a result of which it is affixed to the pipe section 19 in such a way that it cannot move axially. In this context, the locking disk 11 is not tightly clamped, but rather only secured against moving to such an extent that it laterally secures the torsion spring 5 while, at the same time, it can rotate freely with respect to the tube section 19. Radially on the outside, the locking disk 11 is provided with an axial collar 20 fitted with individual fingers 21 by means of which the locking disk 11 engages non-rotatably into corresponding pockets in a collar 22 of the stator 1. In this manner, the locking disk 11 is non-rotatably joined to the stator 1 and non-movably secured to the pipe section 19. Since the locking disk 11 is non-rotatably joined to the stator 1, the rotor 2, together with the section 19 of the pipe 6, also executes the movements relative to the locking disk 11. The locking disk 11 is arranged between the locking ring 10 and the end 7 of the torsion spring 5 with sufficient play so that the rotational movement is not hindered.

Owing to the extension of the locking disk 11 from the radial inside of the torsion spring 5 to beyond the radial outside of the torsion spring 5, the torsion spring 5 is optimally supported laterally. Moreover, the locking disk 11 can be fastened into the pockets of the collar 22 of the stator with considerably less pressing force 1 since, according to the invention, the locking disk 11 is additionally secured axially to the pipe section 19.

Figure 3:
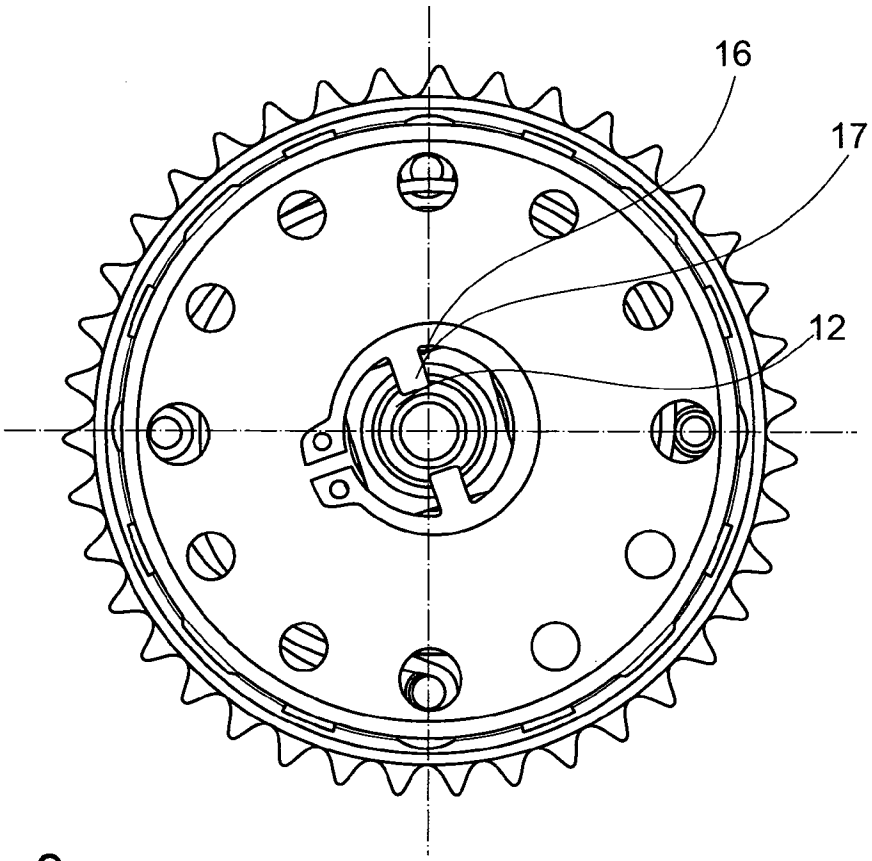
FIG. 3 a camshaft phaser with a torsion spring and a locking part as well as with a central valve.
Figure 3:
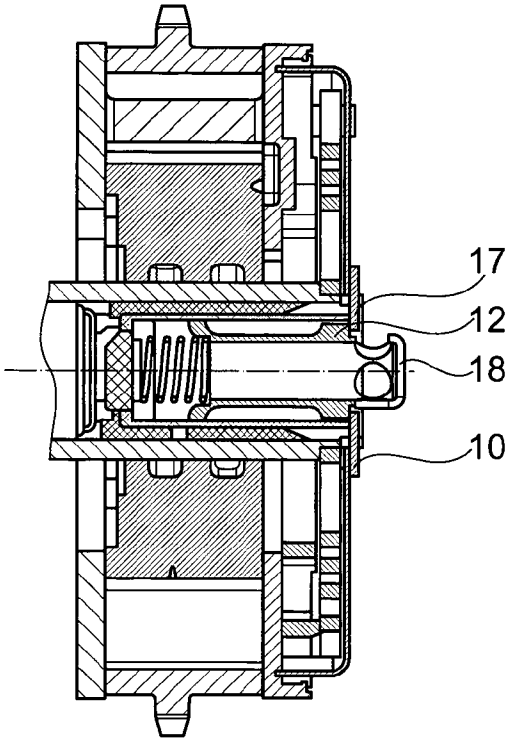

FIG. 3 shows the same camshaft phaser with an inserted central valve 12. The central valve 12 has a movably mounted piston 18 that projects outwards and that is moved by an actuator (not shown here) in order to actuate the camshaft phaser. The locking ring 10 has two opposing tabs 17 with which the locking ring is inserted into grooves 16 of the pipe section 19 that are open on their end face, so that the locking ring 10 is non-rotatably affixed to the pipe section 19. At the same time, the locking ring 10 engages into a radial groove of the pipe section 19 so that the locking ring 10 is also axially secured to the pipe section 19, and the locking disk 11 is axially secured against slipping. In this manner, the radially inner end 7 of the torsion spring 5 is axially secured to the pipe section 19 via the locking disk 11 and via the locking ring 10. If the locking disk 11 can be widened in the area of the central opening for installation purposes, the locking ring 10 can also be eliminated and the locking disk 11, instead, can also engage directly into a groove on the pipe section 19 in order to be secured in the axial direction.

Moreover, the tabs 17 protrude radially inwards to such an extent that they cover the central valve 12 at the end face so that, at the same time, they form a stop for the central valve 12 and the central valve 12 cannot slip out.

LIST OF REFERENCE NUMERALS

1 stator
2 rotor
3 outer teeth
4 sealing cover
5 torsion spring
6 pipe
7 first spring end
8 second spring end
9 flat face
10 locking ring
11 locking disk
12 central valve
13 sealing cover
14 end
15 pin
16 groove
17 tab
18 piston
19 pipe section
20 collar
21 finger
22 collar

What is claimed is:

1. A camshaft phaser comprising:

a stator drivable by a crankshaft of an internal combustion engine;

a rotor non-rotatably joinable to a camshaft of the internal combustion engine and having a central opening;

a torsion spring having helical windings and acting between the rotor and the stator, the torsion spring having a first radially inner end directly or indirectly joined to the rotor, and a second radially outer end directly or indirectly joined to the stator; and a pipe extending through the central opening and having a central, axially protruding pipe section associated with the rotor, the first end of the torsion spring being non-rotatably affixed with a positive fit to the pipe section, wherein the pipe section conveys a pressure medium.

2. The camshaft phaser as recited in claim 1 wherein the pipe section is configured so as to be out-of-round, at least in some sections, and the first end of the torsion spring is non-rotatably affixed to the pipe section due to a shaping adapted to the out-of-round shape of the pipe section.

3. The camshaft phaser as recited in claim 1 wherein the pipe section is part of a central screw to join the rotor to the camshaft.

4. The camshaft phaser as recited in claim 1 wherein the pipe section has a flat face, the first end being in contact with flat face.

5. The camshaft phaser as recited in claim 4 wherein the flat face is in the form of a square and the spring end is in contact with at least three of the straight side faces of the square.

6. The camshaft phaser as recited in claim 1 wherein the torsion spring is secured by a lock part laterally covering windings on an outside.

7. The camshaft phaser as recited in claim 6 wherein the lock part axially secures the first end.

8. The camshaft phaser as recited in claim 6 wherein the lock part is formed by a securing assembly comprising a locking disk and a locking ring securing the locking disk immovably to the pipe section.

9. The camshaft phaser as recited in claim 1 wherein the first end surrounds the pipe section about an angle of at least 270°.

10. The camshaft phaser as recited in claim 1 wherein the pipe has passage openings for the pressure medium.

* * * * *